US009959854B2

(12) United States Patent
Sims et al.

(10) Patent No.: US 9,959,854 B2
(45) Date of Patent: May 1, 2018

(54) PERFORMANCE ENHANCING DEVICE AND RELATED METHODS

(71) Applicants: Almasi A. Sims, Tampa, FL (US); Tony Hines, Tampa, FL (US)

(72) Inventors: Almasi A. Sims, Tampa, FL (US); Tony Hines, Tampa, FL (US)

( * ) Notice: Subject to any disclaimer, the term of this patent is extended or adjusted under 35 U.S.C. 154(b) by 58 days.

(21) Appl. No.: 15/178,157

(22) Filed: Jun. 9, 2016

(65) Prior Publication Data

US 2016/0365078 A1 Dec. 15, 2016

Related U.S. Application Data

(60) Provisional application No. 62/230,569, filed on Jun. 9, 2015.

(51) Int. Cl.

| | |
|---|---|
| ***G10H 3/14*** | (2006.01) |
| ***A41D 1/02*** | (2006.01) |
| ***A41D 19/00*** | (2006.01) |
| ***G10D 13/02*** | (2006.01) |
| ***H04R 1/02*** | (2006.01) |
| *A41D 27/08* | (2006.01) |
| *A41D 1/00* | (2018.01) |

(52) U.S. Cl.

CPC ..... *G10H 3/146* (2013.01); *G10D 13/024* (2013.01); *H04R 1/028* (2013.01); *A41D 1/002* (2013.01); *A41D 19/0024* (2013.01); *A41D 27/08* (2013.01); *G10H 2220/061* (2013.01); *G10H 2220/116* (2013.01); *G10H 2220/326* (2013.01); *G10H 2220/336* (2013.01); *G10H 2220/395* (2013.01); *H04R 2201/023* (2013.01)

(58) Field of Classification Search

CPC ..... G10H 3/146; G10H 2220/061; G10H 2220/116; G10H 2220/326; G10H 2220/395; G10H 2220/336; G10D 13/024; H04R 1/028; H04R 2201/023; A41D 1/002; A41D 19/0024; A41D 27/08

USPC ..... 381/118, 124, 333, 334

See application file for complete search history.

(56) References Cited

U.S. PATENT DOCUMENTS

| | | | | |
|---|---|---|---|---|
| 4,043,241 A | | 8/1977 | Liu | |
| 4,920,848 A | | 5/1990 | Suzuki | |
| 5,461,188 A | * | 10/1995 | Drago | A43B 3/00 36/137 |

(Continued)

*Primary Examiner* — Vivian Chin
*Assistant Examiner* — Douglas Suthers
(74) *Attorney, Agent, or Firm* — Matthew G. McKinney, Esq.; Allen, Dyer, Doppelt & Gilchrist, PA

(57) ABSTRACT

A performance enhancing device includes a first glove configured to be worn on a first hand of a user. The first glove includes a plurality of finger pockets, at least one pressure sensor secured proximate a distal end of a respective finger pocket and configured to produce an output signal, a processor coupled to the at least one pressure sensor and configured to receive the output signal and translate the output signal to a wireless output signal, and an antenna coupled to the processor and configured to transmit the wireless signal. The performance enhancing device also includes a jacket configured to be worn by the user, where the jacket includes a receiver to receive the wireless output signal, an amplifier coupled to the receiver, and a speaker integrated within the jacket and coupled to the amplifier and configured to produce an audible sound.

11 Claims, 5 Drawing Sheets

(56) References Cited

U.S. PATENT DOCUMENTS

| | | | | |
|---|---|---|---|---|
| 7,842,879 | B1 | 11/2010 | Carter | |
| 8,300,823 | B2 | 10/2012 | Bojinov et al. | |
| 8,362,350 | B2 * | 1/2013 | Kockovic | G10H 1/34 84/743 |
| 8,822,800 | B1 | 9/2014 | Richmond | |
| 2004/0112204 | A1 | 6/2004 | Javelle | |
| 2005/0252364 | A1 * | 11/2005 | O'Modhrain | G10H 1/0008 84/737 |
| 2014/0098206 | A1 * | 4/2014 | Rosella | H04R 1/028 348/61 |

* cited by examiner

FIG. 1A
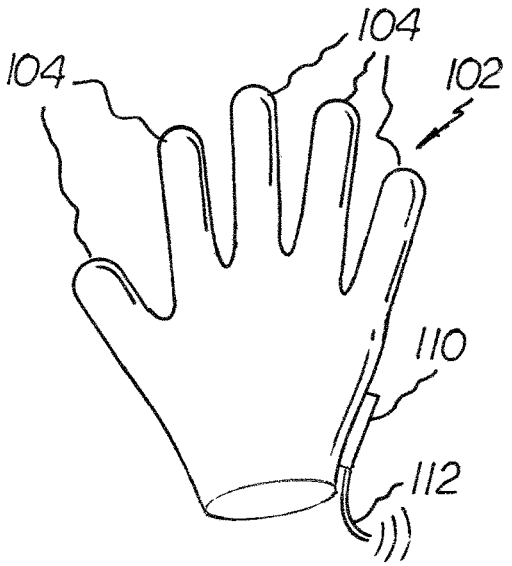
FIG. 1B
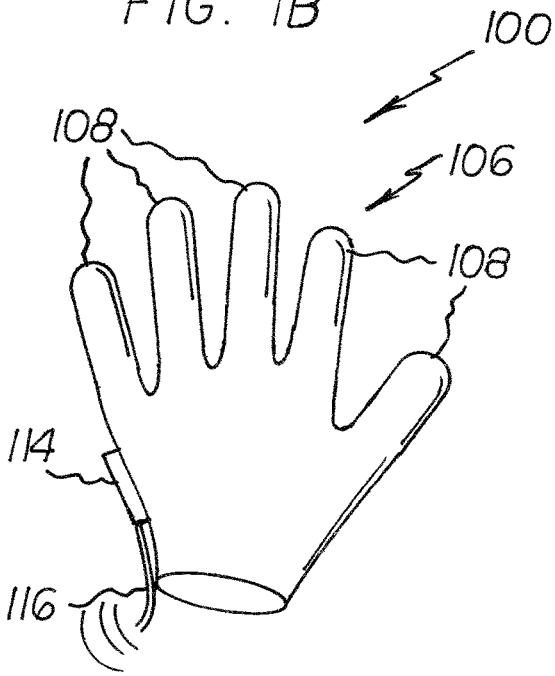
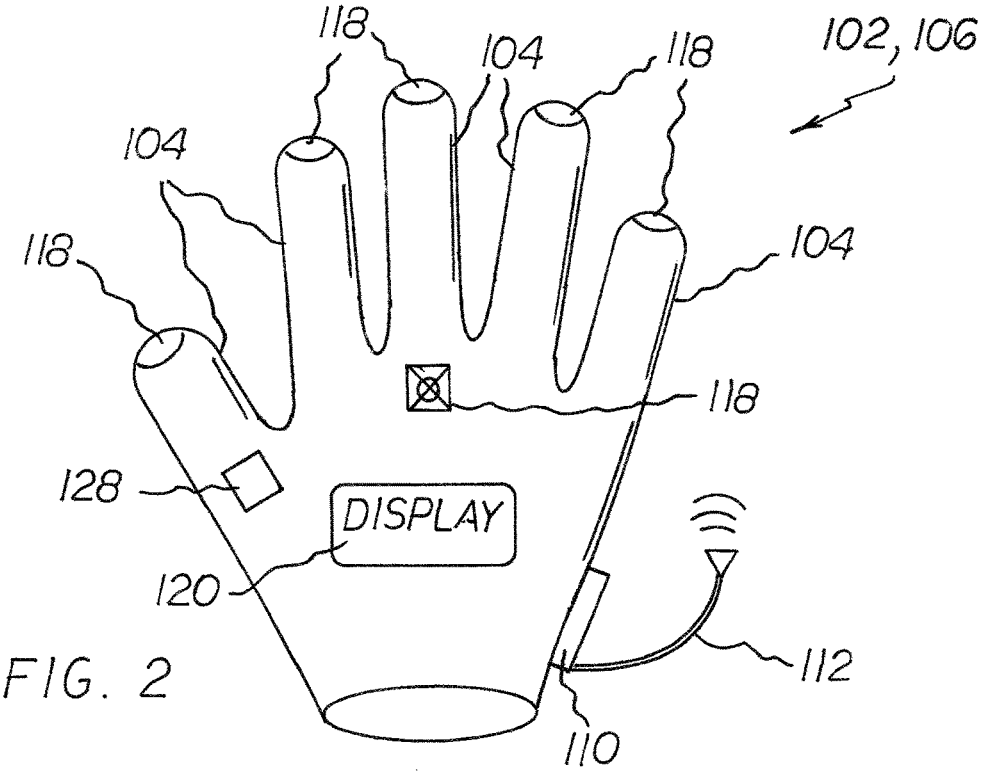
FIG. 2

FIG. 3
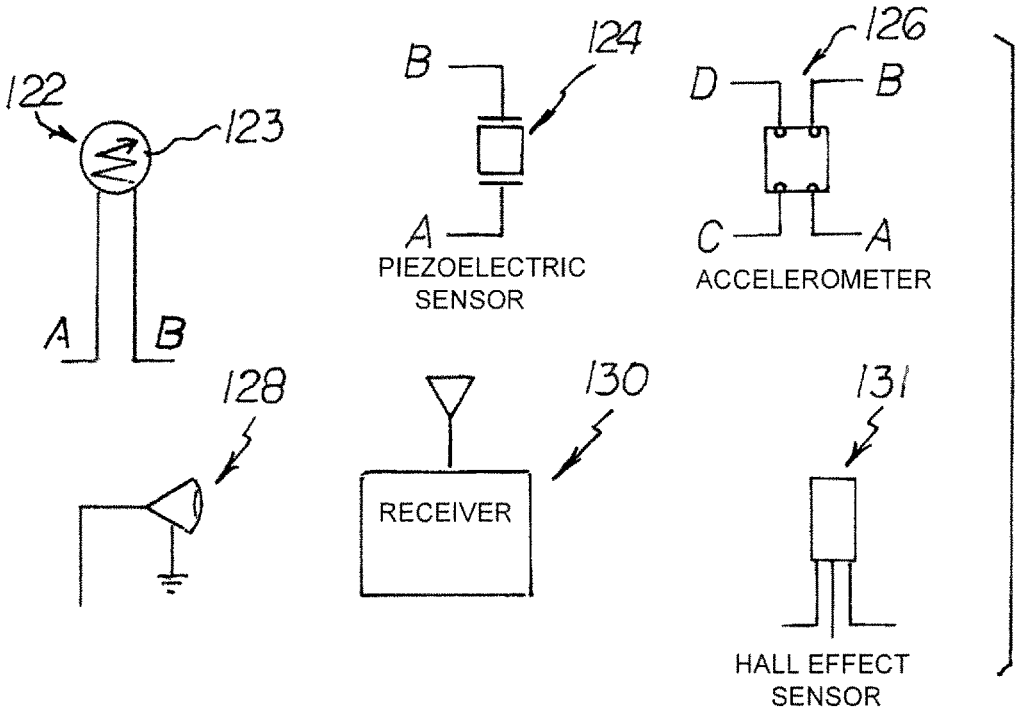
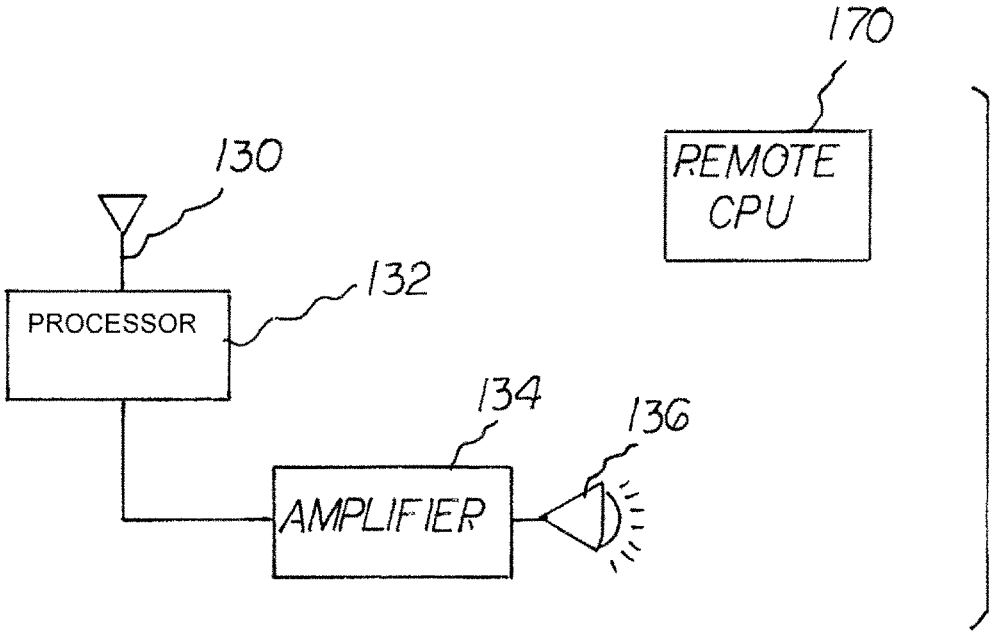
FIG. 4

FIG. 5A
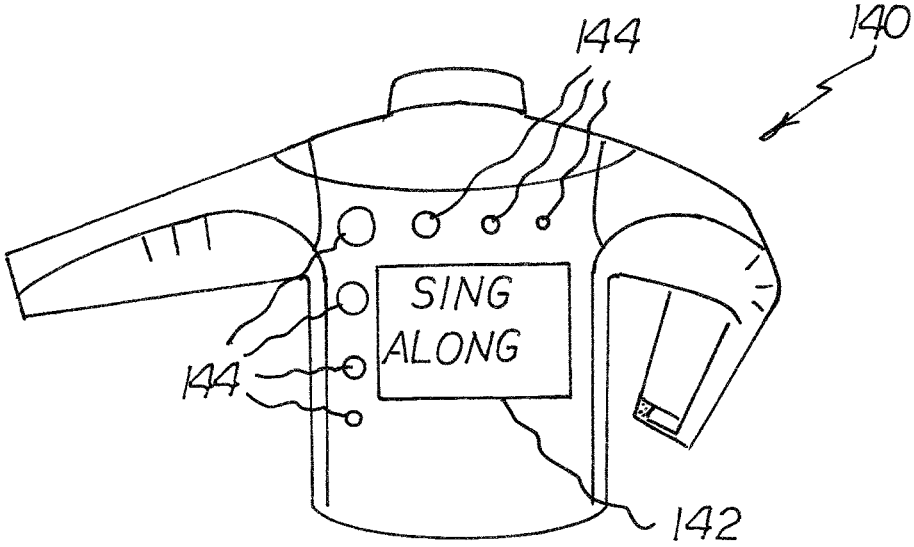
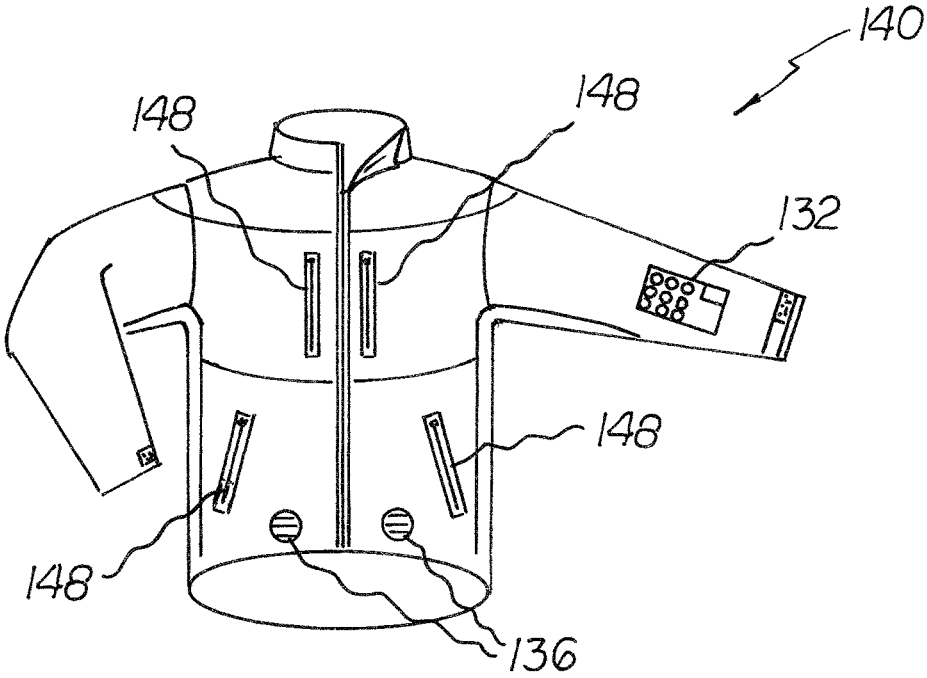
FIG. 5B

FIG. 6A
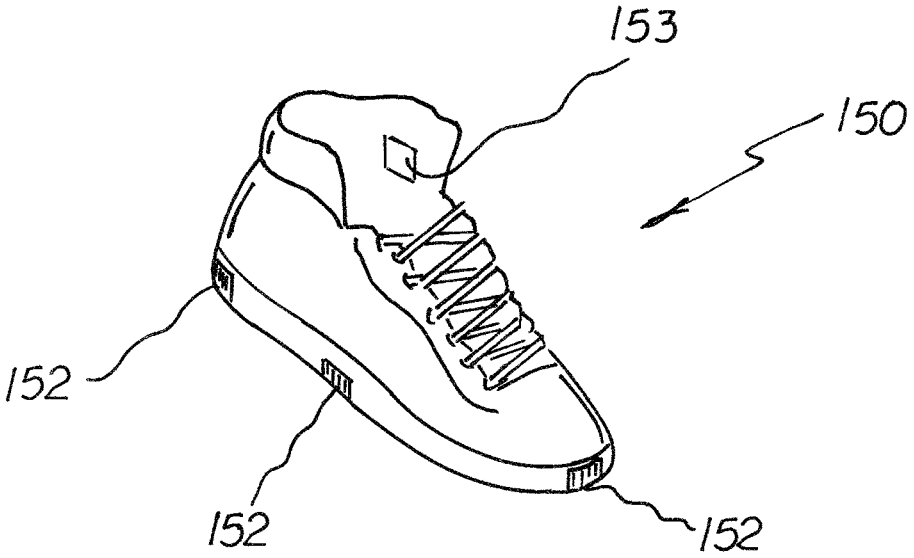
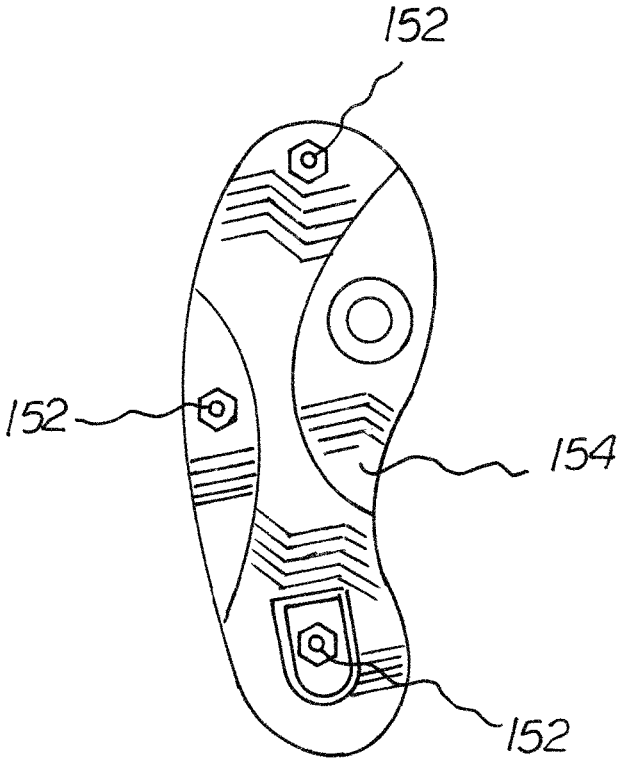
FIG. 6B

PERFORMANCE ENHANCING DEVICE AND RELATED METHODS

TECHNICAL FIELD

The present invention relates to the field of entertainment, and, more particularly, to a performance enhancing device and related methods.

BACKGROUND

There have been attempts to develop musical gloves that are worn by a user to create percussion sounds. However, a shortcoming of the existing musical gloves is that they do not have the ability for controlling sound effects, mixing sounds, and producing backup sounds. Instead, each sensor is pre-programmed for a particular sound when the sensor is triggered and the user does not have the ability to control the music while preforming.

SUMMARY

In view of the foregoing background, it is therefore an object of the present invention to provide a performance enhancing device that allows the user to produce music in real time while performing in order to have a more engaging performances for the audience.

This and other objects, features, and advantages in accordance with the performance enhancing device include apparel with electronics and electronic components embedded therein to replace musical instruments, musical instrument controls, sound controls, light, and other electronic controls and devices for entertainment purposes.

In a particular illustrative embodiment, a performance enhancing device includes a first glove configured to be worn on a first hand of a user. The first glove includes a plurality of finger pockets, at least one pressure sensor secured proximate a distal end of a respective finger pocket and configured to produce an output signal, a processor coupled to the at least one pressure sensor and configured to receive the output signal and translate the output signal to a wireless output signal, and an antenna coupled to the processor and configured to transmit the wireless signal. The performance enhancing device also includes a jacket configured to be worn by the user, where the jacket includes a receiver to receive the wireless output signal, an amplifier coupled to the receiver, and a speaker integrated within the jacket and coupled to the amplifier and configured to produce an audible sound.

In another particular embodiment a method of enhancing a performance is disclosed. The method includes wearing a first glove having a plurality of finger pockets on a first hand of a user. The first glove includes at least one pressure sensor secured proximate a distal end of a respective finger pocket. The method also includes producing an output signal from the at least one pressure sensor, translating the output signal to a wireless signal, transmitting the wireless output signal to a receiver, and generating an audible sound from the wireless signal. The method also includes synchronizing light emitting diodes integrated within a jacket worn by the user with the audible sound.

BRIEF DESCRIPTION OF THE DRAWINGS

FIGS. 1A and 1B are gloves of a performance enhancing device;

FIG. 2 is a detail view of the glove shown in FIG. 1A;

FIG. 3 is an electronic schematic of different sensors of the performance enhancing device;

FIG. 4 is an electronic schematic of an entertainment processor and remote CPU of the performance enhancing device;

FIGS. 5A and 5B are front and rear views of a jacket of the performance enhancing device;

FIGS. 6A and 6B are top and bottom view of a shoe of the performance enhancing device.

DETAILED DESCRIPTION

Figure 7:
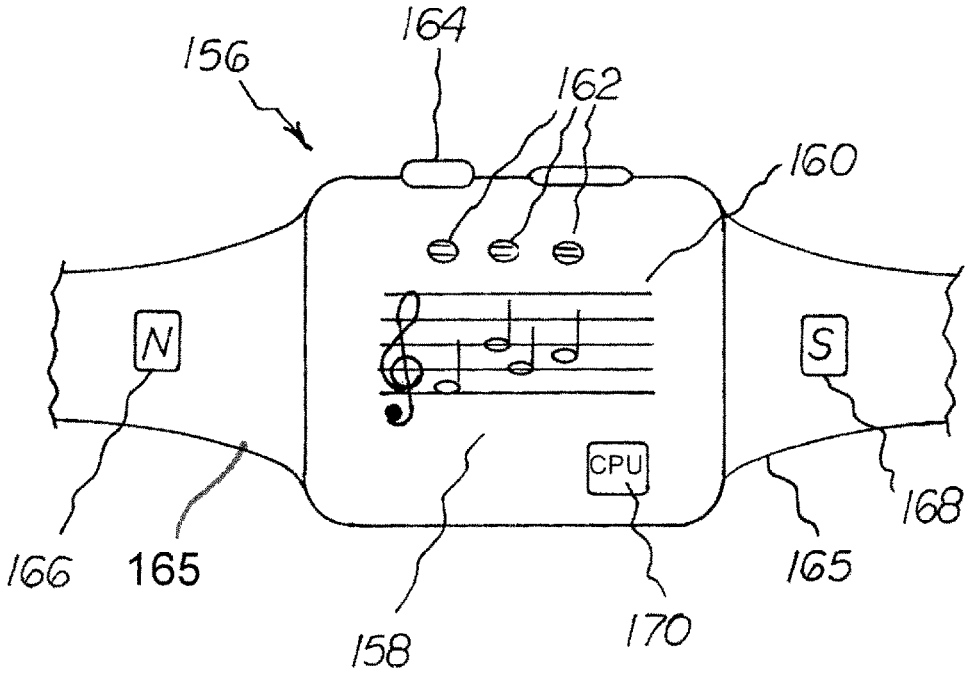
FIG. 7 is a wristband of the performance enhancing device.

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

The performance enhancing device may include electronic sensors and other electronic devices and components integrated within various apparel worn by a person to remotely control electronic equipment including lights for entertainment purposes. The sensors and other electronic devices or components may also be used to remotely generate music, percussion sounds, rhythm sounds and sound effects from electronic equipment for entertainment purposes. For example, drum simulation pads may be included in the fingertips of an interactive glove. By wearing the glove, a user has the ability to simulate a percussion instrument by the tapping of the fingers. The sounds can be percussion or a simulation of other instruments. The performance enhancing device may also include a jacket, for example, having embedded visual displays, cameras, microphones and speakers to generate music and visual and sound effects from electronic equipment for entertainment purposes. In addition, the performance enhancing device may be used to wirelessly transmit the generated media to smart phones and tablets.

The performance enhancing device provides seamless access to the controls, for controlling the volume and playing prerecorded tracks. Accordingly, an audience can witness in real time the entertainers generating and controlling their own music, sound effects, and backup sounds. As described above, music and sound effects can be generated from electronic components integrated within the apparel that the entertainer is wearing. Thus, the entertainer can access and control his music and be an active part of the entertainment by interacting with the audience in real time. The performance enhancing device may even allow the entertainer to eliminate the need for a musician or a disc jockey handling his musical mix and background sounds. In addition, the entertainer can exhibit multiple entertainment disciplines as a solo performance using the performance enhancing device.

The performance enhancing device may also include displays integrated into the apparel in order to provide the entertainer with information and status of the media that is being presented to an audience. The displays may be large enough for the audience to see and thereby the display becomes a part of the entertainment. The apparel may also include integrated speakers and amplification built in to provide sounds emanating from the apparel. The apparel of the performance enhancing device may also have controls that can be used to mix music in real time thereby allowing for more spontaneous creativity. The performance enhancing device can also simulate music and generate music that can be used on a smart phone (e.g., iPhone, or android) and tablets, (e.g., iPads, iPods and Android tablets) for personal entertainment.

Referring initially to FIGS. 1A, 1B and 2, the performance enhancing device 100 includes a first glove 102 and second glove 106, which are pieces of apparel that are worn over the respective hand of the user. Each glove 102, 106 includes respective finger pockets 104, 108 for insertion of fingers. The first glove 102 includes a plurality of sensors 118 and a first processor 110. Similarly, the second glove includes sensors 108 and a second processor 114. Each processor 110, 114 has associated memory and a respective antenna 112, 116. The antenna is used to transmit wireless signals to a receiver 130.

In FIG. 2 the first glove is shown (the second glove 106 includes identical features described with respect to the first glove 102) with the pressure sensors 118 at a distal end of the respective finger pocket 104. The pressure sensors 118 respond to contact and the amount of force applied to the contact. There may also be a pressure sensor 118 on the back of the glove 102, 106 that is accessible by the other hand or can have pressure applied to it by other parts of the body such as a left hand, or by some other object. Accordingly, applying various amounts of pressure can generate or control musical instruments or entertainment equipment.

Therefore, the gloves 102, 106 on the right and left hand with pressure sensors 118 can do monitoring of contact and movement. The pressure sensors 118 in FIG. 2 on the tips of the finger pockets 104 can then be tapped in a percussion or rhythmic fashion onto a solid item such as a table thereby emulating a drum or any percussion instrument. Also certain movements can generate certain musical or rhythmic sounds or sound effects.

A display 120 is secured to a rear surface of the glove. The display 120 may be configured to display menus and choices of actions that each one of the sensors 118 can perform. For example, the display 120 may give the user wearing the glove 102 statuses and update, or any information needed on stage. The display 120 may also act as a miniature teleprompter that can have the order of the performance, information from someone responsible for coordinating the program, performance or show. The display 120 may have music lyrics or musical notes or changes that need to take place in a performance.

Another sensor may also be integrated with the glove 102, 106 such as a sound pickup device like a microphone 128 illustrated in FIG. 2. The microphone 128 can be used to sample and also eliminate holding a standard microphone and by speaking into the glove 102, 106, there is no need to carry a microphone during a performance or dance routine, for example.

Referring now to FIG. 3, one type of pressure sensor is a force sensing resistor 122, which operates to provide a predictable output on the output leads A, B for a given amount of force applied to the surface 123. The pressure sensors may also be a piezoelectric sensor 124 that gives a change in output voltage at connections A, B. An accelerometer 126 can monitor the orientation (top side up or down) of what it is attached to. It can also provide an electrical indication of movement and the direction of the movement using output leads A, B, C, D. It can also use the orientation or movement of the respective glove 102, 106 to control and or generate music effect or control the music or other electronics.

An example of a Hall effect sensor 131 is also shown. The Hall effect sensor 131 responds to the proximity a magnet, or to a magnetic field. The Hall Effect sensor 131 may require an input voltage to its power leads and will generate an output on an output lead. The output voltage on the output lead of the Hall effect sensor 131 will be a percentage of the input voltage that is proportional to the intensity of a magnetic field that it is subjected to, or how close it is to a magnet. The polarity of the output voltage is dependent on which polarity or which pole of a magnet it is closest.

Referring now to FIG. 4, information to and from the pressure sensors 118, and the display 120 may be transmitted wirelessly using the processor 110 and antenna 112 to a receiver 130 of an entertainment processor 132. The entertainment processor 132 can interface to other electronic components like a sound amplifier 134 that drives speakers 136. The receiver 130 collects the signal and passes it on to the entertainment processor 132. The entertainment processor 132 has associated memory and will convert the signal to entertainment information and convey it to the amplifier 134. In a typical arrangement, the electrical energy is converted to mechanical energy by speaker 136. A remote CPU 170 may be in wireless communication with the entertainment processor 132. The remote CPU 170 can receive and transmit signals to operate the display 120, screen 142, wristband 156, speakers 136, LEDs 144, etc., and any other components in communication with the entertainment processor 132, as well as control separate speakers, lights, etc. not integrated into the apparel.

Referring now to FIGS. 5A and 5B, a jacket 140 of the performance enhancing device 100 is illustrated. A sleeve of the jacket 140 may have the entertainment processor 132 integrated therein. The entertainment processor 132 may include buttons or other graphical user interface. As shown in FIG. 5B, speakers 136 may be integrated into the jacket 140 as well as strategically located pockets 148 for battery and electronic components. A screen 142 is coupled to the entertainment processor 132 and can be part of a performance or some form of entertainment. Light emitting diodes or lights 144 that can be synchronized with a choreography or performance may also be integrated into the jacket 140.

Referring now to FIGS. 6A and 6B, the performance enhancing device may also include a shoe 150. The sole 154 of the shoe 150 may also include pressure sensors 152. A toe segment of the shoe 150 is at the distal point from the leg of the user wearing the shoe 150. The pressure sensors 152 are also in communication with the entertainment processor 132 using a wireless communication unit 153. The pressure sensors 152 on shoe 150 at various positions can give indication of movement and dance movement. Sound generated by old fashion taps on shoes can now come out of the speakers 136 and allow for more control including volume and type of sound i.e. beeps, horns, cymbals, keyboard, percussion, or strings.

Referring now to FIG. 7, the performance enhancing device may also include a wristband 156. The wristband 156 may be secured to a wrist of the user by straps 165. The straps 165 may be metal or fabric material, for example. The wristband 156 may include a digital display 158 or readout display of status and relevant information 160. Buttons 162, 164 provide for user input and remote or local control. In addition, a north pole on top oriented magnet 166 and a south pole on top oriented magnet 168 may be integrated into the straps 165 and configured to cooperate with the Hall effect sensor 131 to provide an output signal. The wristband 156 may include an onboard wireless communication unit 170 to allow it to communicate with the entertainment processor 132.

The wristband 156 gives the user during a performance full or partial music and/or esthetical control of certain aspects of a performance or presentation. The wristband 156 may also have certain sensors that can give orientation and motion response such as an accelerometer 126. The wristband 156 may also respond to vibration by using a piezoelectric sensor 124 and Hall effect sensors 131. The buttons 162, 164 can be used as remote and local selection and control. By utilizing the common polarization of magnet repel, a Hall effect sensor (or similar) can be integrated into clothing, where the sensor looks for a specific polarity to respond a certain way. The Hall effect sensor 131 will respond to the proximity and to the polarity of a magnet and give the appropriate output response or control. By incorporating the magnets in the apparel and the Hall effect sensor 131 in the wristband 156, or vice-versa. As illustrated in FIG. 9, there is a north pole on top magnet 166 and a south pole on top magnet 168. The polarized fields from these magnets 166, 168 can provide control or monitoring of the location of the wristband 156.

The performance enhancing device 100 takes advantage of the parts of the body of the user that are not being used and clothing that may be worn. The performance enhancing device 100 attaches electrical components and parts via the apparel to these body parts thereby adding to the entertainment experiences.

This all is orchestrated to the music being presented. Choreography coordinates and syncs to the lights and patterns from the apparels that are designed into a performance with control and feedback to and from the remote CPU 170 all from their apparel.

In operation of the performance enhancing device 100, a user such as an entertainer sings into a microphone while tapping the ends of his fingers on the microphone stand to generate drum sounds. The guitarist while strumming the guitar instrument, taps between strums on the body of the guitar to generate a rhythmic percussion pattern and associated dancers have sensors in their shoes that generate different rhythmic, musical sounds and sound effects.

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the appended claims.

That which is claimed is:

1. A performance enhancing device comprising:

a first glove having a plurality of finger pockets and configured to be worn on a first hand of a user;

at least one pressure sensor secured proximate a distal end of a respective finger pocket and configured to produce an output signal;

a processor coupled to the at least one pressure sensor and configured to receive the output signal and translate the output signal to a wireless output signal;

an antenna coupled to the processor and configured to transmit the wireless signal;

a receiver configured to receive the wireless signal;

an amplifier coupled to the receiver;

a speaker coupled to the amplifier and configured to produce an audible sound;

a jacket configured to be worn by the user, wherein the jacket having the receiver, the amplifier, and the speaker integrated therein and configured to communicate with the first glove;

at least one Hall effect sensor integrated with the jacket; and a wristband having a magnet integrated therein and configured to cooperate with the Hall effect sensor to indicate a proximity of the wristband to the jacket.

2. The performance enhancing device of claim 1, further comprising:

a second glove having a plurality of finger pockets and configured to be worn on a second hand of the user; and at least one pressure sensor secured proximate a distal end of a respective finger pocket of the second glove.

3. The performance enhancing device of claim 1, wherein the first glove comprises an accelerometer coupled to the processor and configured to provide a measurement of movement of the first glove.

4. The performance enhancing device of claim 1, wherein the at least one pressure sensor comprises a force sensing resistor.

5. The performance enhancing device of claim 1, wherein the at least one pressure sensor comprises a piezoelectric pressure sensor.

6. The performance enhancing device of claim 1, further comprising a display secured to the first glove and coupled to the processor.

7. The performance enhancing device of claim 1, wherein the jacket comprises a screen configured to display video.

8. The performance enhancing device of claim 7, wherein the jacket comprises light emitting diodes configured to synchronize with the audible sound.

9. The performance enhancing device of claim 1, further comprising:

a first shoe configured to be worn by a first foot of the user; and at least one pressure sensor coupled to the first shoe.

10. The performance enhancing device of claim 1, further comprising a microphone integrated within the first glove and coupled to the processor.

11. The performance enhancing device of claim 1, further comprising a pressure sensor secured to a rear surface of the first glove and coupled the processor.

* * * * *